US008635819B2

(12) United States Patent
Joray

(10) Patent No.: US 8,635,819 B2
(45) Date of Patent: Jan. 28, 2014

(54) FRAMING FOR PANELS

(71) Applicant: Orchidées-Constructions S.A., St-Aubin-Sauges (CH)

(72) Inventor: Eric Joray, St-Aubin (CH)

(73) Assignee: Orchidees-Constructions SA, St-Aubin-Sauges (CH)

( * ) Notice: Subject to any disclaimer, the term of this patent is extended or adjusted under 35 U.S.C. 154(b) by 0 days.

(21) Appl. No.: 13/954,263

(22) Filed: Jul. 30, 2013

(65) Prior Publication Data

US 2013/0312342 A1 Nov. 28, 2013

Related U.S. Application Data

(63) Continuation of application No. 13/066,260, filed on Apr. 11, 2011.

(30) Foreign Application Priority Data

Dec. 8, 2010 (EP) ..... 10194169

(51) Int. Cl.

| | |
|---|---|
| ***E06B 3/00*** | (2006.01) |
| ***E06B 3/32*** | (2006.01) |
| ***E06B 7/00*** | (2006.01) |
| ***E06B 3/988*** | (2006.01) |

(52) U.S. Cl.

USPC ..... 52/204.51; 52/204.5; 52/204.591; 52/204.595; 52/204.6; 52/204.71

(58) Field of Classification Search

USPC ..... 52/204.5, 204.51, 204.57, 204.591, 52/204.595, 204.6, 204.62, 204.71, 204.72

See application file for complete search history.

(56) References Cited

U.S. PATENT DOCUMENTS

| | | | |
|---|---|---|---|
| 5,579,616 | A | 12/1996 | Farag |
| 6,327,826 | B1 | 12/2001 | Mann |
| 7,162,842 | B2 | 1/2007 | Ribic |
| 2005/0005543 | A1 | 1/2005 | Ribic |
| 2005/0166494 | A1 | 8/2005 | Guhl |
| 2006/0026913 | A1 | 2/2006 | Turner |
| 2007/0186494 | A1 | 8/2007 | Hancock |

FOREIGN PATENT DOCUMENTS

| | | | |
|---|---|---|---|
| FR | 2 363 686 | A2 | 3/1978 |
| WO | 2010119354 | A1 | 10/2010 |

*Primary Examiner* — Mark Wendell

(74) *Attorney, Agent, or Firm* — Krieg DeVault LLP; Clifford W. Browning

(57) ABSTRACT

Framing for panels, in particular for sliding panels, which may or may not be sliding windows, arranged to enclose and hold one or more single or multiple parallel glazing units, and having at least one frame in two parts formed from profiled parts and assembled so that their relative position can be modified, each of the profiled parts having at least one longitudinal wing which enclose a glazing unit, wherein each of the profiled parts has at least one pair of parallel transverse wings, namely an upper transverse wing and a lower transverse wing respectively, at least partially fitting around at least one insulation element, and in that the transverse wings and the insulation element are configured to ensure the connection of the parts of each frame, the width of the insulation element being adjusted at the time of mounting according to the thickness of the glazing unit or units.

20 Claims, 8 Drawing Sheets

FRAMING FOR PANELS

CROSS-REFERENCE TO RELATED APPLICATIONS

The present application claims priority to European Patent Application 10194169.8, filed Dec. 8, 2010.

TECHNICAL FIELD

The present invention relates to framing for panels, in particular sliding panels, especially for windows which may or may not be sliding windows. The present invention aims to rationalize the industrial production and to facilitate the mounting of the framing while ensuring the thermal insulation and the sealing tightness of traditional framing.

STATE OF THE ART

In the means for framing panels, in particular windows, the profiled parts, constituent elements of the frame, are assembled with or without an insulation element, according to two types of operation: crimping or fitting together.

Crimping is a mechanical assembly technique which consists of folding and turning over the end of a first mechanical element onto a second to form a tight joint. After crimping, the two mechanical elements are fixedly attached to one another, the connection between the elements being rigid. Crimping offers a generally sealed connection. When positioning an insulation element in a judicious manner between the elements to be crimped, the assembled structure has an insulating effect. On the other hand, crimping necessitates appropriate means and tools such as crimping presses, so that it is difficult to carry out at the mounting site. Crimping does not achieve flexibility and adaptability during mounting and thus does not permit effective rationalization of production. The total of the costs relating to crimping is also high.

In order to overcome the disadvantages of crimping it is known to use two-part framing formed of pairs of complementary profiled parts having longitudinal wings which enclose a glazing unit and transverse wings which fit one inside the other to form the frame and hold the glazing unit. The said parts of each frame are fixed to each other by connection members traversing the wings which are fitted one inside the other. The depth to which the transverse wings fit together is determined upon mounting depending on the thickness of the glazing unit. Strips of insulating synthetic material can be interposed in the fitting arrangement of the transverse wings of each part of the frame, these strips acting as thermal insulation. In order to be able to fit one inside the other and to form a rigid structure, the transverse wings are complex in shape so that industrial production of the frame becomes troublesome and expensive. The stability of the structure also depends strongly on machining and mounting precision as well as the connection members used. The thickness of the glazing unit may mean that the transverse wings are only partially fitted together. Such an assembly is thus sometimes deficient in sealing tightness and thermal insulation.

The present invention thus aims to provide a solution to the problems mentioned above.

DISCLOSURE OF THE INVENTION

To this end, the present invention concerns a framing for panels, in particular for sliding panels, especially for windows which may or may not be sliding windows, arranged to enclose and hold one or more single or multiple parallel glazing units and having at least one frame in two parts formed from profiled parts and assembled so that their relative position can be modified, each of the said profiled parts having at least one longitudinal wing which enclose a glazing unit, wherein each of the said profiled parts has at least one pair of parallel transverse wings, namely an upper transverse wing and a lower transverse wing respectively, at least partially fitting around at least one insulation element, and in that the transverse wings and the insulation element are configured to ensure the connection of the said parts of each frame, the width of the insulation element being adjusted at the time of mounting according to the thickness of the glazing unit or units. Other possible configurations of the invention are defined in the dependent claims.

The invention thus configured provides framing in which the different parts of the frame are connected without any additional connection member being used. The mounting of the framing is thus thereby facilitated. Moreover, by modifying only the width of the insulation element without changing the profiled part elements, the framing of the invention can easily be adapted to glazing units of various thicknesses. Industrial production can thus be facilitated and rationalized. Furthermore, in a preferred configuration of the invention, the insulation element can advantageously act as both a thermal barrier and as a sealing element. The way the insulation element fits tightly inside the transverse wings of the profiled parts will also make it possible to substantially reduce the thermal losses at this location.

BRIEF DESCRIPTION OF THE DRAWINGS

Other advantages and features of the present invention will be better understood from reading of particular embodiments of the invention and with reference to the drawings in which.

DETAILED DESCRIPTION OF THE EMBODIMENTS OF THE INVENTION

Figure 1:
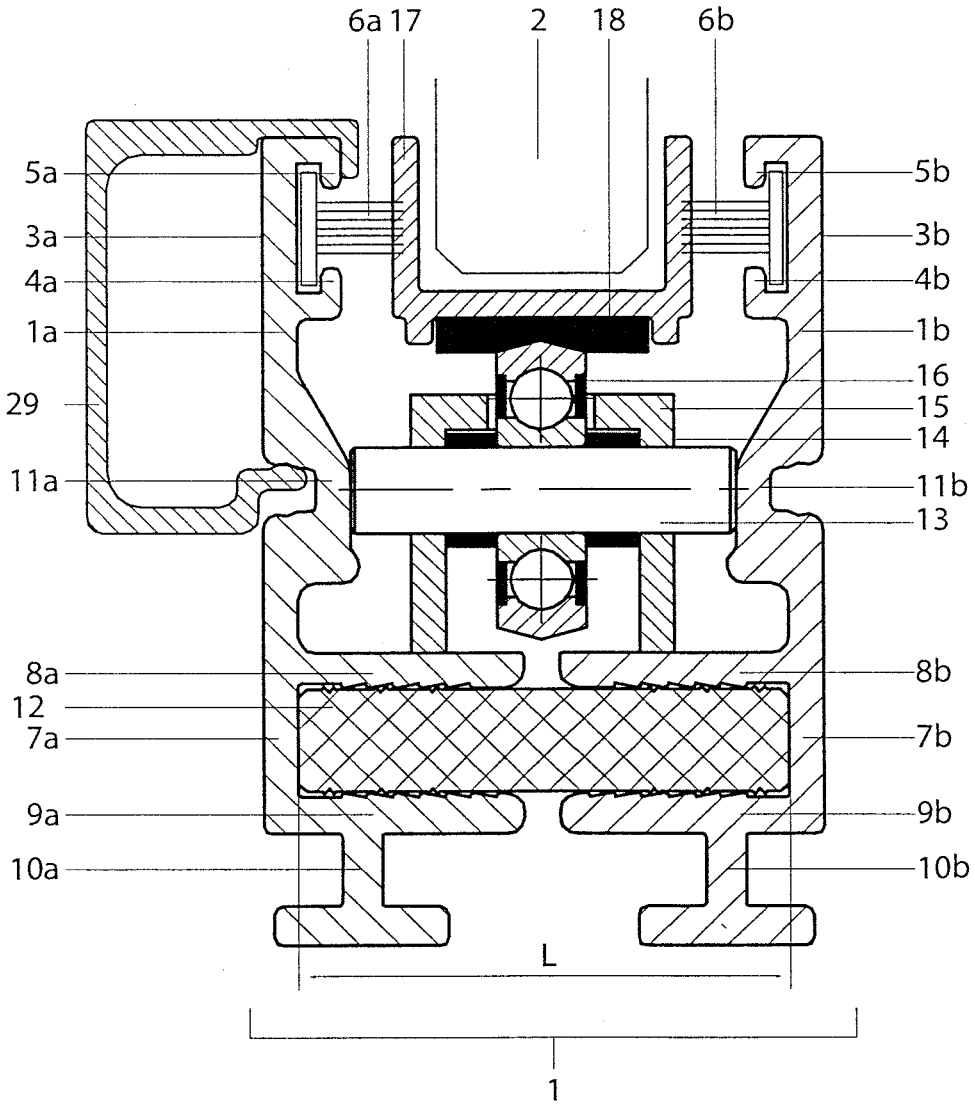
FIG. 1 is a vertical cross-sectional view of the lower part of a frame in accordance with the invention in a single glazing unit application.

FIG. 1 is a vertical cross-sectional view of framing, a frame 1 of which supports and guides a single glazing unit 2 mounted in a sliding manner. The frame 1 is formed from straight profiled parts 1*a* and 1*b* which can be made from aluminum or another light alloy, if applicable in another alloy or material, in particular a synthetic material, and an insulation element 12 fitted into the profiled parts 1*a* and 1*b*. The profiled part 1*b* is the inverse of the profiled part 1*a* with respect to a vertical axis of symmetry.

The profiled parts 1*a* and 1*b* respectively have a longitudinal wing 3*a* and 3*b* with, in their upper part, a pair of re-entrant edges 4*a*, 5*a* and 4*b*, 5*b* which hold brushes 6*a* and 6*b* in contact with the support 17 of the glazing unit 2 and, in their lower part, a respective inner boss 11*a* and 11*b* for centering the ball bearing 16. At the base of the longitudinal wings 3*a* and 3*b*, the profiled parts 1*a* and 1*b* respectively have a pair of inner transverse wings 8*a*, 9*a* and 8*b*, 9*b*. The transverse wings of each profiled part are parallel and oriented in the same direction so as to create a space in which an element with a rectangular cross-section can come to be engaged. According to FIG. 1, the transverse wings 8*a*, 9*a* and 8*b*, 9*b* are dimensioned so as to fit together with the insulation element 12.

The fitting arrangement is defined when the two lateral faces of the insulation element 12 come into contact with the vertical surfaces of the elements 7*a* and 7*b* of the profiled parts 1*a* and 1*b* joining the two transverse wings 8*a*, 9*a* and 8*b*, 9*b*. The profiled parts 1*a* and 1*b* being symmetrical, the widths of the transverse wings are less than half the width L of the insulation element. The insulation element is itself dimensioned for mounting according to the thickness of the glazing unit 2. The length of the shaft 13 of the ball bearing 16 is, for its part, also dimensioned according to the thickness of the glazing unit 2.

Figure 2:
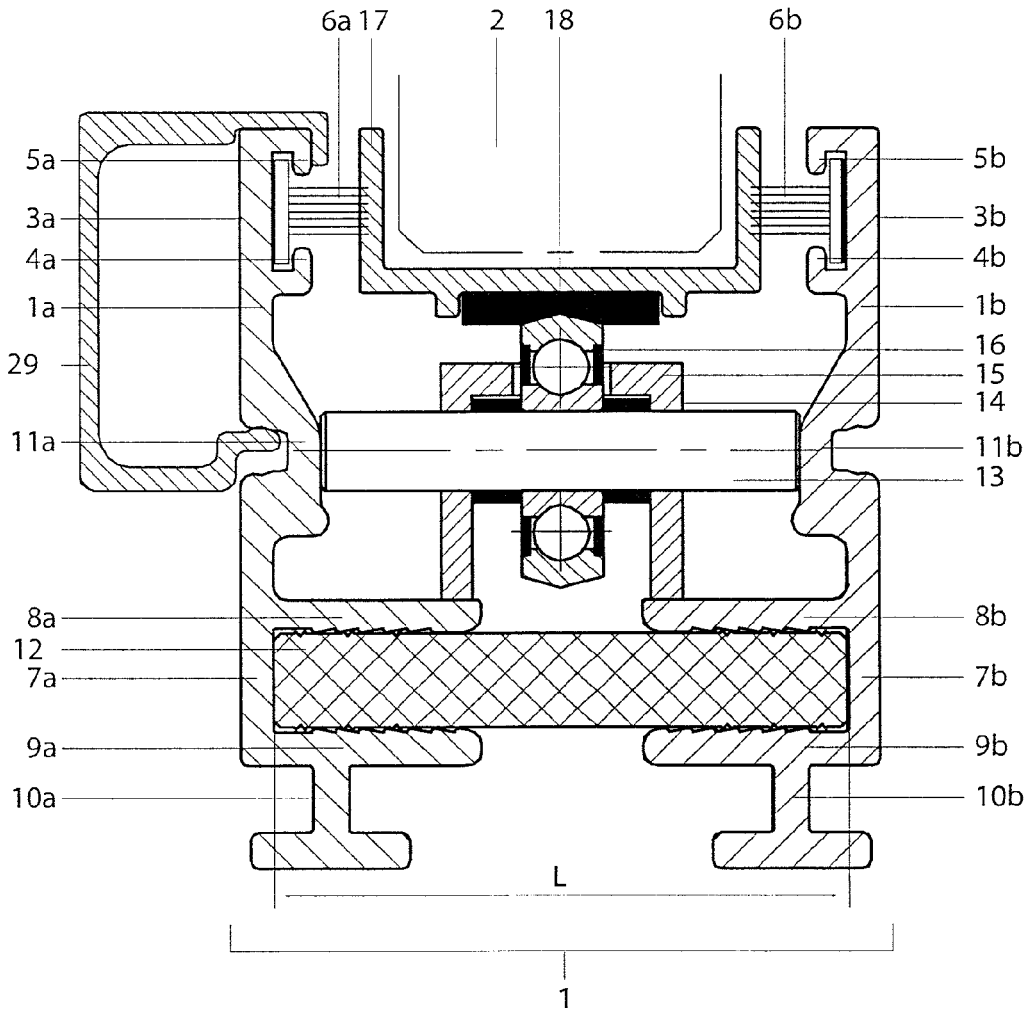
FIG. 2 is a vertical cross-sectional view of the lower part of a frame in accordance with the invention in a single glazing unit application, this one being thicker than that of FIG. 1.

By way of example, FIG. 2 shows a vertical cross-sectional view of framing, a frame 1 of which supports and guides a single glazing unit 2, this being thicker than that of FIG. 1. The same elements as in FIG. 1 appear in FIG. 2 which means that it is not necessary to list them again. In view of the thickness of the glazing unit, the relative positions of the profiled parts 1*a* and 1*b* are modified with respect to FIG. 1, their spacing being greater, and the width L of the insulation element 12 is increased so as to create the desired fitting arrangement between the pairs of transverse wings 8*a*, 9*a* and 8*b*, 9*b* and the insulation element 12. As mentioned above, the width L of the insulation element 12 is defined according to the thickness of the glazing unit. It will also be noted that the length of the shaft 13 is increased with respect to that of the shaft shown in FIG. 1.

Figure 3:
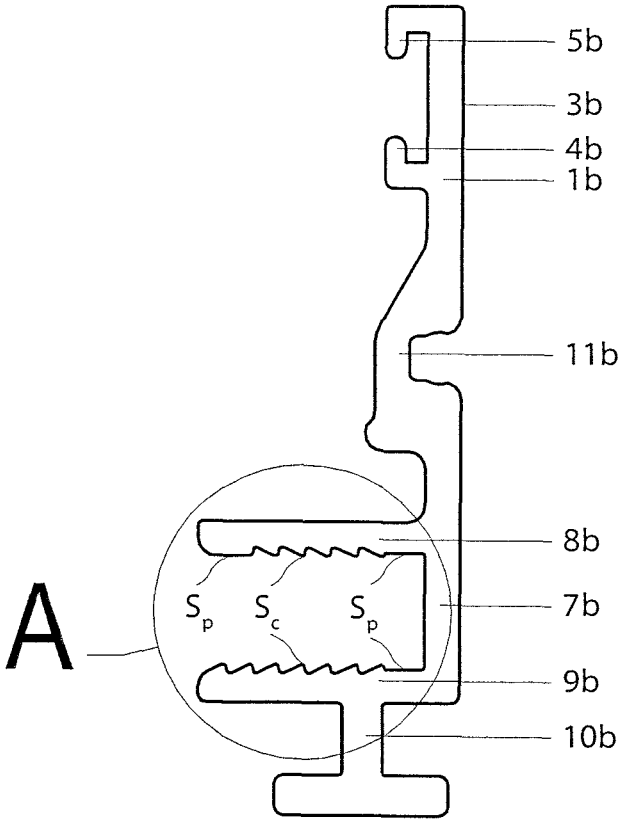
FIG. 3 is a vertical cross-sectional view of a single profiled part, a constituent element of the frame shown in FIGS. 1 and 2.
Figure 4:
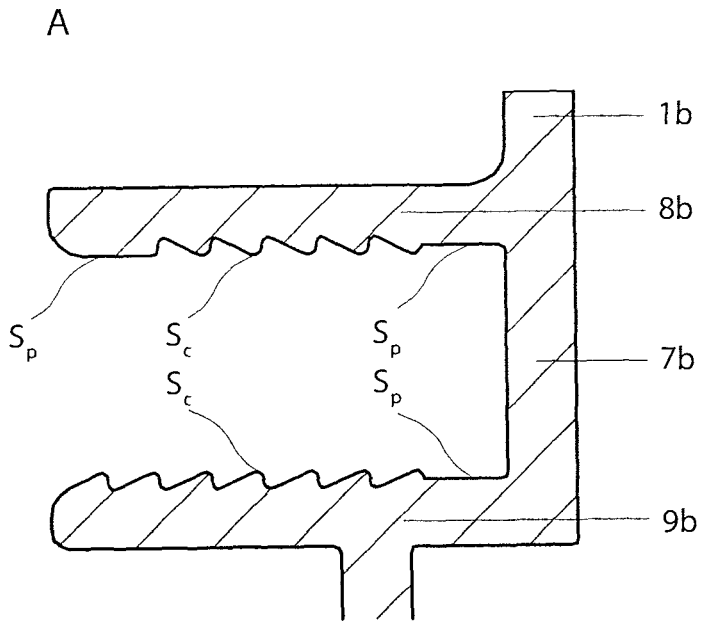
FIG. 4 is a vertical cross-sectional, detailed view of the transverse wings of the profiled part shown in FIG. 3.

At this stage it is important to note that no additional connection member is used between the profiled parts 1*a*, 1*b* and the insulation element 12. The transverse wings and the insulation element themselves connect the two parts of the frame. FIG. 3 shows a vertical cross-sectional view of a profiled part 1*b*, constituent element of the frame shown in FIGS. 1 and 2. FIG. 4 is a vertical cross-sectional, detailed view of the transverse wings of the profiled part shown in FIG. 3. The inner surfaces of the lower and upper transverse wings of the profiled parts intended to come into contact with the insulation element have planar portions $S_p$ separated by notched portions $S_c$. The notched portions $S_c$ of the inner surfaces are formed by a plurality of parallel lines in relief, each line having a substantially triangular profile and extending at least partially projecting with respect to the plane defined by the planar portions $S_p$. These relief lines can extend over only a part of the length of the profiled parts 1*a* and 1*b* or, in a preferred form, over the whole length of the profiled parts 1*a* and 1*b*. Furthermore, other profiles can be chosen for the relief lines. In particular it can be envisaged to use trapezoidal profiles or any other polygonal profile, of which at least one side forms an acute angle with the plane defined by the planar surfaces $S_p$. In the example illustrated, each relief line has a profile in the form of a right-angled triangle, the catheti of which are respectively in a plan parallel to that defined by the planar portions $S_p$ and perpendicular to this plane. The angle formed by the hypotenuse and by the cathetus perpendicular to the transverse wing is rounded in a fillet. The relief lines in each of the notched portions $S_c$ are juxtaposed to each other with no interruption. Moreover, the relief lines of the notched portions $S_c$ formed on the upper transverse wings 8*a* and 8*b* are oriented oppositely to the relief lines of the notched portions $S_c$ formed on the lower transverse wings 9*a* and 9*b*. In the case of the upper transverse wing 8*b*, adjacent to the part 7*b* of the profiled part 1*b*, the inner surface of the transverse wing 8*b* is planar over a width corresponding to less than a quarter of the width of the transverse wing 8*b*. Moving towards the free end of the transverse wing 8*b*, this planar portion $S_p$ adjoins a notched portion $S_c$ of a width corresponding to more than half the length of the transverse wing 8*b*. This notched portion $S_c$ then extends in the direction of the free end of the transverse wing 8*b* in a planar portion $S_p$. In the case of the lower transverse wing 9*b*, adjacent to the part 7*b* of the profiled part 1*b*, the inner surface of the transverse wing 9*b* is planar over a width corresponding to less than a quarter of the width of the transverse wing 9*b*. Moving towards the free end of the transverse wing 9*b*, this planar portion $S_p$ adjoins a notched portion $S_c$ of a width corresponding to more than half the length of the transverse wing 9*b*. The free ends of the transverse wings 8*b* and 9*b* are rounded in a fillet in order to facilitate the fitting of the insulation element.

Figure 5:
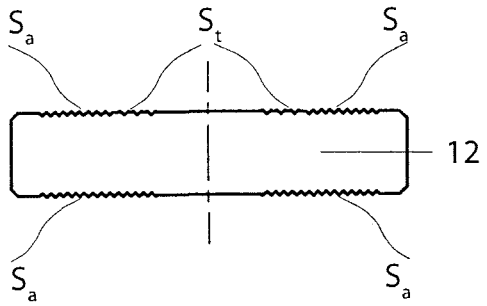
FIG. 5 is a vertical cross-sectional, detailed view of the insulation element shown in FIG. 1.

FIG. 5 shows a detailed, cross-sectional view of the insulation element 12 of FIG. 1. This element is made from PVC or another insulating synthetic material. It has a vertical axis of symmetry. The outer surfaces intended to come into contact with the inner surfaces of the transverse wings 8*a*, 9*a* and 8*b*, 9*b* have at least one anchoring strip $S_a$, the said anchoring strip being configured to interact with a notched portion $S_c$ of one of the transverse wings in such a way as to prevent disconnection, without the use of tools, between the insulation element 12 and the profiled parts 1*a* and 1*b*. This anchoring strip $S_a$ can in particular have a surface condition sufficiently rough to anchor the relief lines of the notched portions $S_c$ of the transverse wings. It can in a subsidiary or additional manner have relief lines complementary to those of the notched portions $S_c$. Thus, in the illustrated example, this anchoring strip $S_a$ has been formed by cross-knurling a part of the outer surface of the insulation element 12. Knurling is understood to be the operation consisting of producing ridges and grooves on a surface. The process by which this is achieved in this case is a material deformation process. The material is in fact stamped locally so as to create areas of over-thickness and under-thickness with respect to the initial surface. This type of knurling can be achieved by means of knurling tools brought into contact with the piece or by constrained rolling between racks. The over-thickness and under-thickness with respect to the initial surface obtained in this case are between 0.1 mm and 0.7 mm. In the case of the upper surface of the insulation element, starting from one of the lateral ends of the insulation element, the surface is planar over a width corresponding to less than a quarter of the width of the insulation element. Moving towards the vertical axis of symmetry of the insulation element, this planar surface adjoins a surface $S_a$ cross-knurled at 30° of a width corresponding to between a quarter and a half of the width of the insulation element, the said cross-knurled surface acting as an anchoring strip. Then moving towards the axis of symmetry of the insulation element, this cross-knurled surface extends into a surface $S_t$ comprising straight-knurling over a width corresponding to less than a quarter of the width of the insulation element. The straight-knurling is produced in the direction of the length of the insulation element. As we will see later, this surface $S_t$ serves in particular as a sealing strip owing to the fact that it makes it possible to limit the entry of water which make take place through the space separating the transverse wings and the insulation element. From this straight-knurled surface $S_t$ to the axis of symmetry of the insulation element, the surface is then planar. In the case of the lower surface of the insulation element, at one of the lateral ends of the insulation element, the surface is planar over a width corresponding to less than a quarter of the width of the insulation element. Moving towards the vertical axis of symmetry of the insulation element, this planar surface adjoins a surface $S_a$ cross-knurled at 30° of a width corresponding to between a quarter and a half of the width of the insulation element. This cross-knurled surface then extends as far as the axis of symmetry of the insulation element as a planar surface.

Once the insulation element 12 has been fitted between the transverse wings 8*a*, 9*a* and 8*b*, 9*b*, a part of the notched portions $S_c$ of the lower transverse wings 9*a*, 9*b* and upper transverse wings 8*a*, 8*b* is in contact with the cross-knurled areas of the lower and upper surfaces respectively of the insulation element 12. The thickness of the insulation element is dimensioned with respect to the spacing of the transverse wings 8*a* and 9*a* or 8*b* and 9*b* so that a gripping type tight fit is achieved. In particular, the distance between the lower and upper transverse wings 8*a* and 9*a* or 8*b* and 9*b* will advantageously be less than the thickness of the insulation element 12. This gripping type tight fit and the conjunction of the notched portions $S_c$ of the transverse wings 8*a*, 9*a* and 8*b*, 9*b* and of the anchoring strips $S_a$ of the insulation element 12 ensure that the parts of the frames are connected to each other. Of course, in one configuration, which is not shown, it may be envisaged that notched portions $S_c$ are not provided on the transverse wings and/or anchoring strips $S_a$ are not provided on the insulation element. In this case the connection of the two parts of the frame can be effected solely by means of the gripping type tight fit. Once the fitting action is carried out, the insulation element becomes fixedly attached to the profiled parts of the frame. The framing is thus formed.

Thermal insulation is ensured by the insulation element 12 and the gripping type tight fit. Sealing tightness is ensured for its part by the conjunction of the planar portions $S_p$ of the upper transverse wings 8*a* and 8*b* and the straight-knurled surfaces $S_t$ of the insulation element 12 as well as by the gripping type tight fit. In fact, once mounting has been carried out, the straight ridges and grooves of the surfaces $S_t$, resulting from the straight-knurling, are intended to come into contact with a planar portion $S_p$ of the upper transverse wings 8*a* and 8*b*. However, the Applicant has unexpectedly discovered that such a configuration greatly improves the sealing tightness with respect to a configuration where the planar portions $S_p$ would be in contact with a planar surface or cross-knurled surface of the insulation element 12.

In FIGS. 1 and 2, the profiled part 29, connected to the profiled part 1*a*, is a removable decorative element. The bosses 11*a* and 11*b* as well as the transverse wings 8*a* and 8*b* of the respective profiled parts 1*a* and 1*b* respectively serve to centre and hold a support and rolling device 14 in the frame 1 between the longitudinal wings 3*a* and 3*b*. The support device 14 is formed from a rail 15 in the shape of an inverted U placed straddling the upper transverse wings 8*a* and 8*b*, from a series of shafts 13 passing through the rail 15 transversely and each supporting a ball bearing 16. The glazing unit 2 held and guided in the frame 1 has a glass upright 17 in which the glazing unit is capped. A roller strip 18 is applied below the glass upright 17 so as to cause the glazing unit 2 to rest on the rollers 16. The brushes 6*a* and 6*b* guide the movement.

Figure 6:
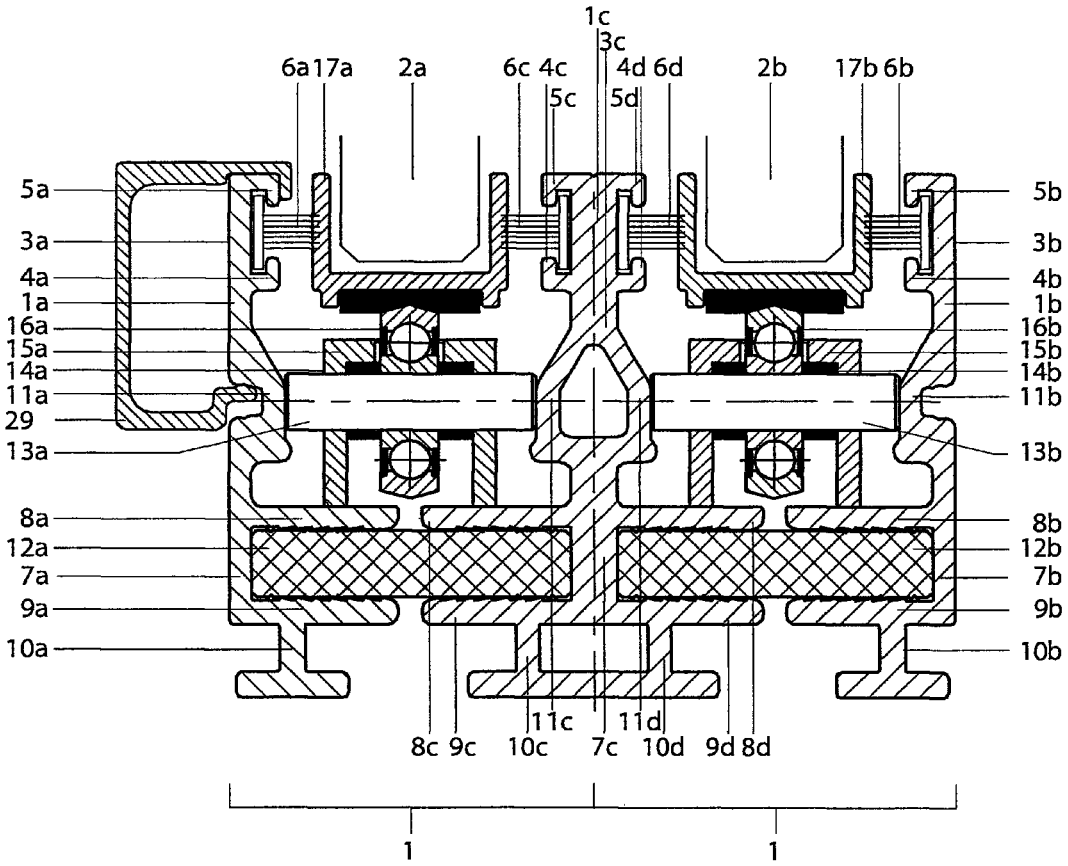
FIG. 6 is a vertical cross-sectional view of the lower part of framing with two frames formed from two single profiled parts shown in FIG. 3 and from a double profiled part shown in FIG. 7.
Figure 7:
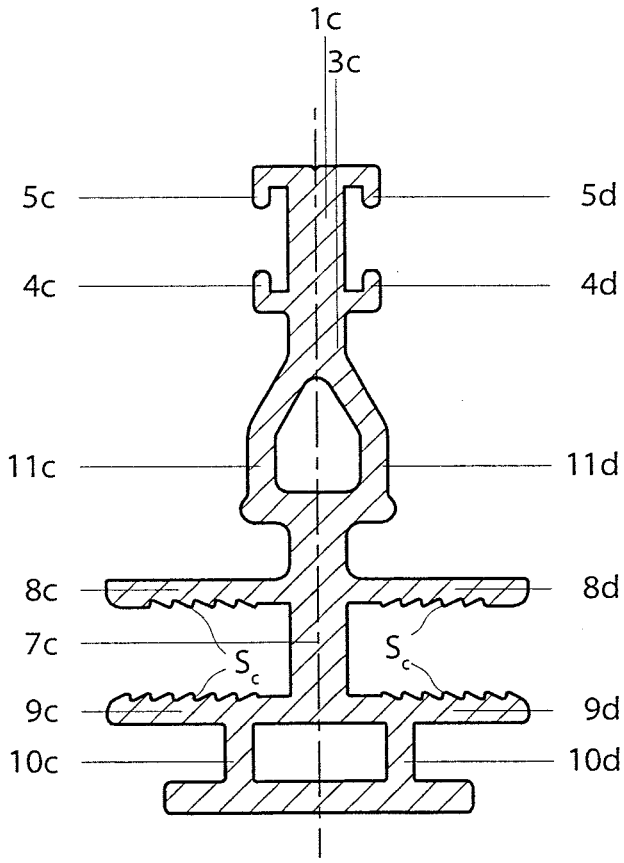
FIG. 7 is a vertical cross-sectional view of a double profiled part, a constituent element of the frame shown in FIG. 6.

FIG. 6 shows framing made of two frames. In each of these frames, except for the double profiled part 1*c*, the same elements are found as in FIG. 1 so that it is not necessary to list them again. As with the profiled parts 1*a* and 1*b*, the double straight profiled part 1*c* can be of aluminum or another light alloy, if applicable of another alloy or material, in particular a synthetic material. The double profiled part 1*c* has a vertical axis of symmetry and is shown in detail in FIG. 7. It has a longitudinal wing 3*c* with, in its upper part, on either side of the profiled part, two pairs of re-entrant edges 4*c*, 5*c* and 4*d*, 5*d* which hold brushes 6*c* and 6*d* in contact respectively with the support 17*a* of the glazing unit 2*a* and the support 17*b* of the glazing unit 2*b* and, in its lower part and on either side of the profiled part, inner bosses 11*c* and 11*d* for centering ball bearings 16*a* and 16*b* respectively. At the base of the longitudinal wing 3*c*, the double profiled part 1*c* has two pairs of transverse wings 8*c*, 9*c* and 8*d*, 9*d* on either side of the profiled part. In each of these pairs, the transverse wings are parallel and oriented in the same direction so as to create a space in which an element with a rectangular cross-section can come to be engaged. In this manner, the transverse wings 8*c*, 9*c* and 8*d*, 9*d* of the profiled part 1*c* are connected to the insulation elements 12*a* and 12*b* of the two neighboring frames. The inner surfaces of the transverse wings of the profiled part 1*c* which are intended to come into contact with the insulation elements 12*a* and 12*b* are notched in an identical manner to the transverse wings of the single profiled part 1*b* of FIG. 1, shown in detail in FIGS. 3 and 4.

Figure 8:
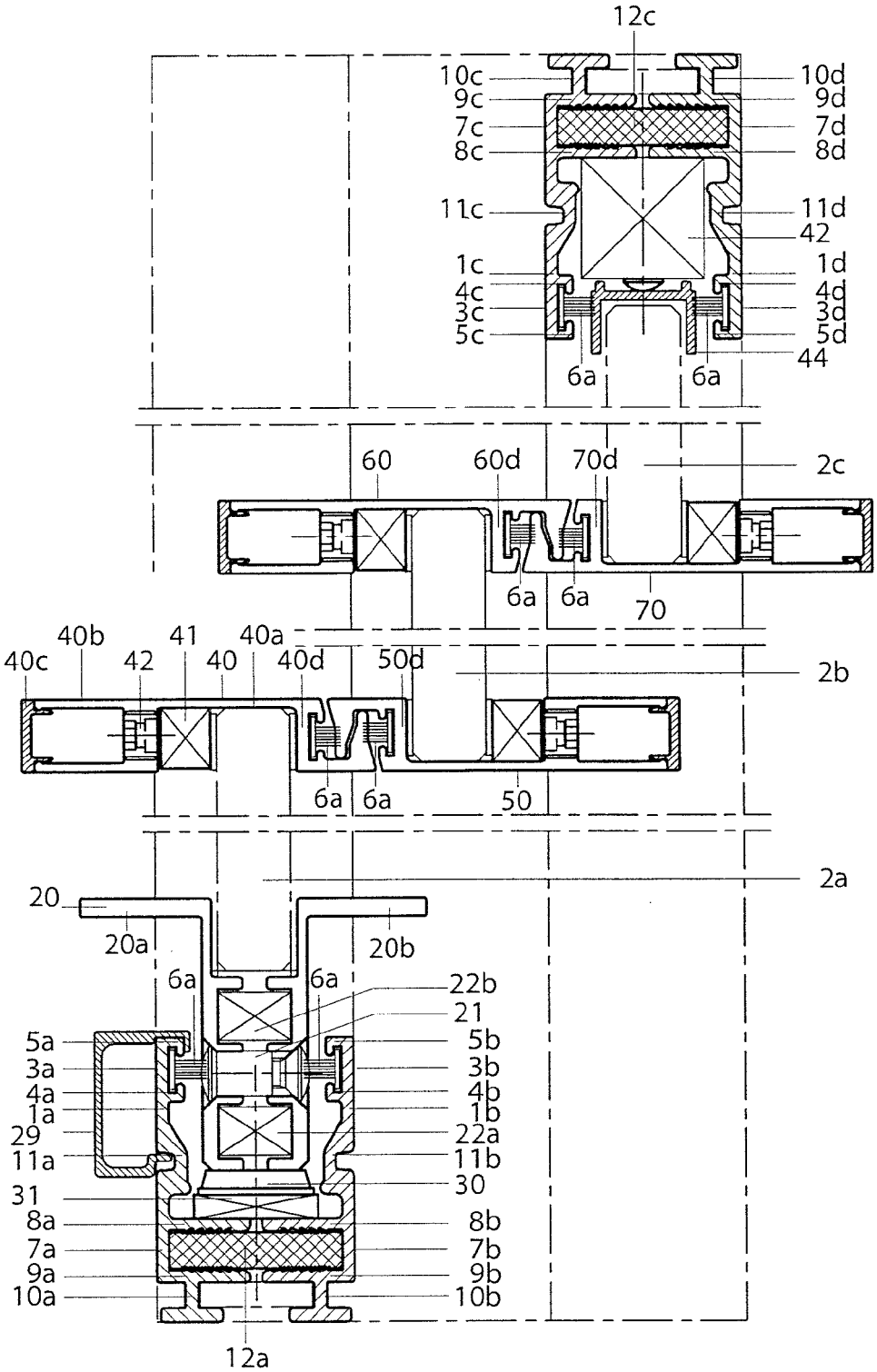
FIG. 8 is a horizontal cross-sectional view showing the conventional arrangement of a sliding window with a single glazing unit in framing with three frames in accordance with the invention.

FIG. 8 shows a horizontal cross-section of the arrangement of the glazing units in window framing with three frames and three glazing units. The glazing units 2*a* and 2*b* are sliding, while the glazing unit 2*c* is fixed. The glazing units 2*a* and 2*b*, supported and guided in the frames, are capped with glass uprights of a different design than in FIG. 1, this being dictated by the necessity of moving the glazing unit elements. The upright vertical sides of the frames are spaced apart from each other by a distance corresponding to the maximum extension with all of the three glazing units. The glazing units 2*a* and 2*b* are guided on their upper and lower horizontal sides by the profiled parts 1*a* and 1*b* of a frame 1 as shown in FIG. 1.

In the retracted position, the glazing unit 2*a* is in abutment against a stop 30 held on an intermediate piece 31. The longitudinal wings 20 which permit anchoring of the glazing unit in order to move it have two profiled part segments 20*a* and 20*b* fixed to each other by screw elements or pins 21 with intermediate pieces 22*a* and 22*b* being held. At the opposite end of the glazing unit, the vertical upright of the glass upright consists of a profiled part 40 with a front plate 40*a*, a lateral gripping structure 40*b*, which is hollow and provided with a closure strip 40*c* extending as a protrusion at the outer end of the said front plate. At the other end of the plate 40*a*, the vertical upright of the glass upright consists of a U-shaped profile arrangement 40*d* with a wing retaining a brush 6*a* and an abutment wing intended to come to be fitted into the U-shaped profile arrangement 50*d* of the neighboring frame. The element 40 of the glass upright is clamped against the glazing unit 2*a* by an intermediate piece 41 actuated by a nut and screw system 42 accessible in the gripping structure 40*b*.

In abutment against the intermediate piece 42, the glass upright 44 of the fixed glazing unit 2*c* is housed in the space between the profiled parts 1*c* and 1*d* of the frame placed in the framing opposite to the glazing unit 2*a*. This glass upright is identical to that designated by 17 in FIG. 1 and engaged between the profiled parts 1*a* and 1*b* of the frame 1. At the opposite end of the glazing unit 2*c*, a glass upright 70 is mounted against the rear flank of the glazing unit 2*c*.

Given that the framing of FIG. 8 is an assembly of three frames with three single glazing units, the second glazing unit of the framing comes to be placed, when the window is in its fully closed position, as an intermediate glazing unit in an intermediate position between the first and third which have just been described. The glass upright of this intermediate glazing unit 2*b* includes, at its two ends, vertical elements 50 and 60 respectively having a U-shaped profile arrangement 50*d* and 60*d*. When the three glazing units 2*a*, 2*b* and 2*c* are in the deployed position, FIG. 8 shows the mutual engagement of the U-shaped profile arrangements 40*d* and 50*d* as well as arrangements 60*d* and 70*d*. In fact, the two U-shaped structures 40*d* and 50*d* are arranged in an inverse position so as to create a mutual engagement. The structures 60*d* and 70*d* are also disposed in an inverse position. The mutual engagements of the U-shaped structures 40*d*, 50*d* and 60*d*, 70*d* are configured so as to ensure sliding of the glazing units 2*a* and 2*b*. In fact the glazing units 2*a* and 2*b* can be brought into an open position by sliding in the direction of the fixed glazing unit 2*c* in the length of the frames.

The invention claimed is:

1. Framing for panels arranged to enclose and hold one or more single or multiple parallel glazing units and having at least one frame in two parts formed from profiled parts and assembled so that their relative position can be modified, each of the said profiled parts having at least one longitudinal wing which enclose a glazing unit, wherein each of the said profiled parts comprises at least one upper transverse wing and one lower transverse wing parallel thereto, said transverse wings at least partially fitting around at least one insulation element rectangular in cross-section and comprising an upper surface and a lower surface, wherein said transverse wings comprises inner surfaces in contact with corresponding surfaces of the upper and lower surfaces of the insulation element, said inner surfaces of the transverse wings having at least one planar portion and at least one notched portion, wherein said corresponding surfaces of the upper and lower surfaces of the insulation element have at least one anchoring strip, the said anchoring strip being cross-knurled and configured to interact with the said notched portion of said inner surfaces of the transverse wings, said notched portion and said anchoring strip being configured to ensure the connection of the said parts of each frame, and wherein the upper surface of the insulation element has at least one sealing strip, said sealing strip being straight-knurled, in contact with said planar portion of the upper transverse wing and configured to interact with said planar portion of the upper transverse wing so as to limit the entry of water through the space between the upper transverse wing and the insulation element.

2. Framing according to claim 1, wherein the thickness of the insulation element is greater than or equal to the distance between the upper transverse wing and the lower transverse wing so that the insulation element and transverse wings are tight fitted.

3. Framing according to claim 1, wherein said notched portion is formed of a plurality of parallel lines in relief, the said relief lines having a substantially triangular profile and extending at least partially projecting with respect to the plane defined by the said planar portion.

4. Framing according to claim 1, formed from a plurality of frames placed side by side, wherein in each frame a double profiled part has a vertical axis of symmetry so that the transverse wings of this profiled part are connected to the insulation elements of two neighboring frames.

5. Framing according to claim 1, wherein the said transverse wings hold, in the frame, roller supports on which single or multiple glazing unit rests, the single or multiple glazing unit being held between two longitudinal wings of the frame profiles parts and mounted so as to slide in the frame.

6. Framing according to claim 5, wherein in each frame a plurality of roller supports are aligned over the whole length of the lower side of the frame, a rail in the shape of an inverted U is placed straddling the upper transverse wings of the frame profiled parts and one or a plurality of ball bearings are each mounted on a shaft supported perpendicularly by the sides of the said rail.

7. Framing according to claim 5, wherein the profiled parts comprises each an inner boss for centering said ball bearing.

8. Framing according to claim 3, wherein the relief lines of the notched portions of the upper transverse wings are oriented oppositely to the relief lines of the notched portions of the lower transverse wings.

9. Framing according to claim 1, wherein the cross-knurled anchoring strip comprises ridges and grooves between 0.1 mm and 0.7 mm thickness.

10. Framing according to claim 1, wherein the anchoring strip is cross-knurled at 30° relative to the length of the insulation element.

11. Framing according to claim 1, wherein the sealing strip is straight-knurled in the direction of the length of the insulation element.

12. Framing according to claim 1, wherein said insulation element has a vertical axis of symmetry.

13. Framing according to claim 12, wherein the upper surface of the insulation element comprises two anchoring strips symmetric with respect to said vertical axis of symmetry.

14. Framing according to claim 12, wherein the lower surface of the insulation element comprises two anchoring strips symmetric with respect to said vertical axis of symmetry.

15. Framing according to claim 12, wherein the upper surface of the insulation element comprises two sealing strips symmetric with respect to said vertical axis of symmetry.

16. Framing according to claim 12, wherein the upper surface of the insulation element comprises, from one of the lateral ends of the insulation element to the vertical axis of symmetry of the insulation element, a planar surface of a width corresponding to less than a quarter of the width of the insulation element, a cross-knurled anchoring strip of a width corresponding to between a quarter and a half of the width of the insulation element, a straight-knurled sealing strip of a width corresponding to less than a quarter of the width of the insulation element and a planar surface extending to said axis of symmetry.

17. Framing according to claim 12, wherein the lower surface of the insulation element comprises, from one of the lateral ends of the insulation element to the vertical axis of symmetry of the insulation element, a planar surface of a width corresponding to less than a quarter of the width of the insulation element, a cross-knurled anchoring strip of a width corresponding to between a quarter and a half of the width of the insulation element and a planar surface extending to said axis of symmetry.

18. Framing according to claim 1, wherein the width of the insulation element is related to the thickness of the glazing unit so that the transverse wings at least partially fit around said insulation element in a manner that the two lateral faces of the insulation element is into contact with the vertical surfaces of the elements of the profiled parts joining the two transverse wings.

19. Framing according to claim 1, wherein the insulation element is made from PVC.

20. Framing according to claim 1, wherein the profiled parts are symmetric with respect to a vertical axis of symmetry.

* * * * *